US007401583B2

(12) United States Patent
Slinkard

(10) Patent No.: US 7,401,583 B2
(45) Date of Patent: Jul. 22, 2008

(54) ADJUSTABLE VALVE TIMING SYSTEM

(75) Inventor: Gene R. Slinkard, Bernie, MO (US)

(73) Assignee: Caterpillar Inc., Peoria, IL (US)

( * ) Notice: Subject to any disclaimer, the term of this patent is extended or adjusted under 35 U.S.C. 154(b) by 43 days.

(21) Appl. No.: 11/398,594

(22) Filed: Apr. 6, 2006

(65) Prior Publication Data

US 2006/0225679 A1 Oct. 12, 2006

Related U.S. Application Data

(60) Provisional application No. 60/668,814, filed on Apr. 7, 2005.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 5,174,169 A * 12/1992 Allen ..... 74/395
5,738,055 A 4/1998 Allen
6,318,321 B1 * 11/2001 Kensok et al. ..... 123/90.31
6,532,923 B2 3/2003 Woodward et al.
6,684,837 B2 * 2/2004 Miyakoshi ..... 123/90.17

OTHER PUBLICATIONS

Saavedra, Larry, "Making Sense of Cam Gears," 8 pages, (undated).
Saavedra, Larry, "Making Sense of Cam Gears," http://forums.trinituner.com/forums/archive/makeing-sence-of-cam-gears-38163.htm, online posting dated Nov. 23, 2004, 7 pages.

* cited by examiner

*Primary Examiner*—Zelalem Eshete
(74) *Attorney, Agent, or Firm*—Finnegan, Henderson, Farabow, Garrett & Dunner

(57) ABSTRACT

An adjustment device for changing the relative rotation between a cam and a crankshaft is provided. The adjustment device includes a driven device operatively connected to the crankshaft. The driven device has a first plurality of channels directed radially inward toward a central axis. The adjustment device also has a hub axially aligned with the driven device along the central axis and connectable to the cam. The hub has a second plurality of channels directed inward toward a point radially offset from the central axis.

16 Claims, 5 Drawing Sheets

ADJUSTABLE VALVE TIMING SYSTEM

RELATED APPLICATIONS

This application is based upon and claims the benefit of priority from U.S. Provisional Application No. 60/668,814 by Gene Slinkard, filed Apr. 7, 2005, the contents of which are expressly incorporated herein by reference.

TECHNICAL FIELD

The present disclosure is directed to a valve timing system and, more particularly, to an adjustable valve timing system.

BACKGROUND

An internal combustion engine typically includes at least one cylinder that receives a piston to form a combustion chamber. The piston is connected to a crankshaft such that a rotation of the crankshaft results in a corresponding reciprocating motion of the piston within the cylinder. Intake and exhaust valves associated with each combustion chamber are indirectly connected to the same crankshaft by way of a timing device such that a rotation of the crankshaft results in corresponding opening and closing movements of the intake and exhaust valves. Thus, the movements of engine valves and the motion of an associated piston, because of their connections to a common crankshaft, are synchronized.

The timing of the opening and closing movements of the intake and exhaust valves relative to the reciprocating motion of the piston may affect performance of the engine. However, this timing of the engine is typically fixed during manufacture of the engine according to a predicted general application of the engine. If operating in a manner other than that predicted by the engine manufacturer, resulting performance of the engine may be less than desired.

In order to maximize the performance of the engine for a particular application, it may be necessary to adjust the relative timing between the movements of the engine valves and the motion of the piston. One method of adjusting this relative timing is described in U.S. Pat. No. 6,532,923 (the '923 patent) issued to Woodward et al. on Mar. 18, 2003. The '923 patent describes varying the typically fixed valve timing of an engine in order to improve combustion. Specifically, the '923 patent discloses an adjustable camshaft sprocket assembly securable to a camshaft that drives intake and exhaust valves. The camshaft sprocket assembly includes a camshaft sprocket driven by a crankshaft and removably securable to a camshaft sprocket hub when the camshaft sprocket assembly is clamped to the camshaft. The camshaft sprocket hub includes a short dowel recess and a long dowel opening offset from the short dowel recess. The camshaft sprocket includes only a long dowel recess. A timing adjustment tool is provided that includes a short dowel, a long dowel, and a handle protrusion. After loosening bolts that axially clamp the camshaft sprocket assembly to the camshaft, the long dowel of the timing adjustment tool is passed through the long dowel opening of the cam sprocket hub into the long dowel recess of the cam sprocket, while the short dowel is inserted only into the short dowel recess of the cam sprocket hub. As torque is applied to the handle protrusion of the timing adjustment tool, the torque is transferred through the engagement of the short and long dowels with the camshaft sprocket and camshaft sprocket hub to generate relative rotation between the two. This relative rotation adjusts an angular orientation between the crankshaft and the camshaft and, thereby, actuation timing of the intake and exhaust valves relative to the motion of an associated piston.

Although the adjustable camshaft sprocket assembly of the '923 patent may improve the combustion process by providing adjustable valve timing, it may be prone to slippage and inaccuracy. In particular, because all torque passing from the camshaft sprocket assembly to the camshaft and visa versa is transmitted only by way of an axial clamping force, it may be possible for rotational slippage to occur between the camshaft sprocket assembly and the camshaft. This slippage could produce inaccurate relative timing that results in undesired performance of the engine and possibly damage to the engine. In addition, because the timing adjustment between the camshaft sprocket assembly and the camshaft is achieved only by a one-to-one ratio of timing adjustment tool rotation to camshaft sprocket assembly rotation, high accuracy of relative timing may be difficult to achieve.

The adjustable valve timing system of the present disclosure solves one or more of the problems set forth above.

SUMMARY OF THE DISCLOSURE

In one aspect, the present disclosure is directed to an adjustment device for changing the rotational timing between a cam and a crankshaft. The adjustment device includes a driven device operatively connected to the crankshaft. The driven device includes a first plurality of channels directed radially inward toward a central axis. The adjustment device also includes a hub axially aligned with the driven device along the central axis and connectable to the cam. The hub includes a second plurality of channels directed inward toward a point radially offset from the central axis.

In another aspect, the present disclosure is directed to another adjustment device for changing the rotational timing between a cam and a crankshaft. The adjustment device includes a driven device operatively connected to the crankshaft. The driven device includes a first plurality of channels directed radially inward toward a central axis. The adjustment device also includes an adjuster having a second plurality of channels spiraled away from the central axis.

In yet another aspect, the present disclosure is directed to a method of adjusting valve timing. The method includes applying torque to an adjuster. The application of torque results in a radial movement of a slider block and a rotation of a hub.

DETAILED DESCRIPTION

Figure 1:
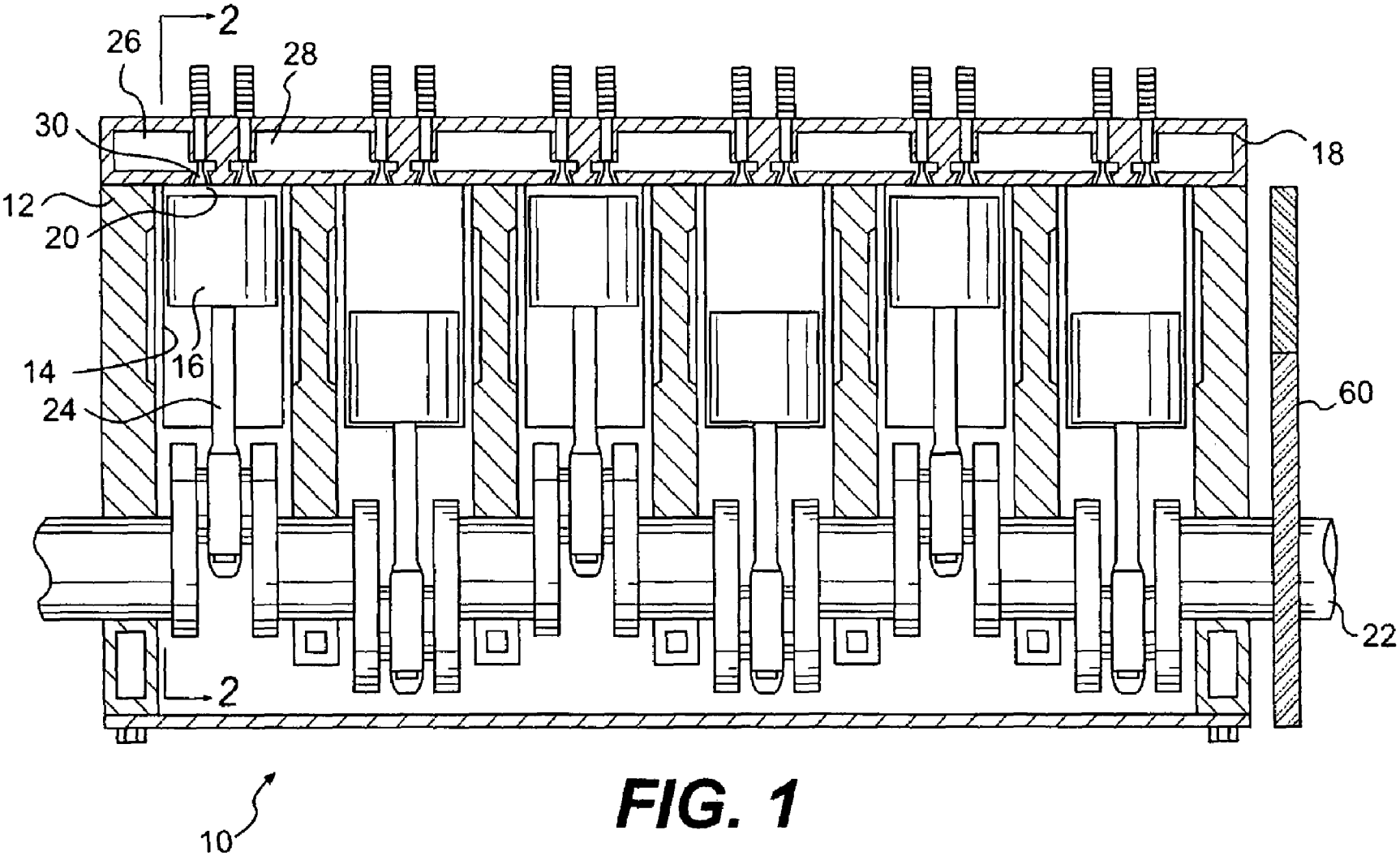
FIG. 1 is a schematic illustration of an exemplary disclosed power system.

FIG. 1 illustrates an exemplary embodiment of a power source 10. For the purposes of this disclosure, power source 10 is depicted and described as a four-stroke engine. One skilled in the art will recognize that power source 10 may embody any type of internal combustion engine such as, for example, a heavy fuel engine, a diesel engine, a gasoline engine, a gaseous fuel-powered engine, or any other suitable engine. Power source 10 may include an engine block 12 that defines a plurality of cylinders 14.

A piston 16 and a cylinder head 18 may be associated with each cylinder 14 to form a combustion chamber 20. Specifically, piston 16 may be slidably disposed within each cylinder 14 to reciprocate between a top-dead-center position and a bottom-dead-center position. Cylinder head 18 may be positioned to cap off an end of cylinder 14, the space within cylinder 14 between piston 16 and cylinder head 18 being the combustion chamber 20. In the illustrated embodiment, power source 10 includes six combustion chambers 20. However, it is contemplated that power source 10 may include a greater or lesser number of combustion chambers 20 and that combustion chambers 20 may be disposed in an "in-line" configuration, a "V" configuration, or in any other suitable configuration.

Power source 10 may also include a crankshaft 22 rotatably disposed within engine block 12. A connecting rod 24 may connect each piston 16 to crankshaft 22 so that a sliding motion of piston 16 between the top-dead-center and bottom-dead-center positions within each respective cylinder 14 results in a rotation of crankshaft 22. Similarly, a rotation of crankshaft 22 may result in a sliding motion of piston 16 between the top-dead-center and bottom-dead-center positions. In a four-stroke engine, piston 16 may reciprocate between the top-dead-center and bottom-dead-center positions through an intake stroke, a compression stroke, a combustion or power stroke, and an exhaust stroke.

Cylinder head 18 may define an intake passageway 26 and an exhaust passageway 28. Intake passageway 26 may direct air into combustion chamber 20. Exhaust passageway 28 may direct exhaust gases from combustion chamber 20 to the atmosphere.

Figure 2:
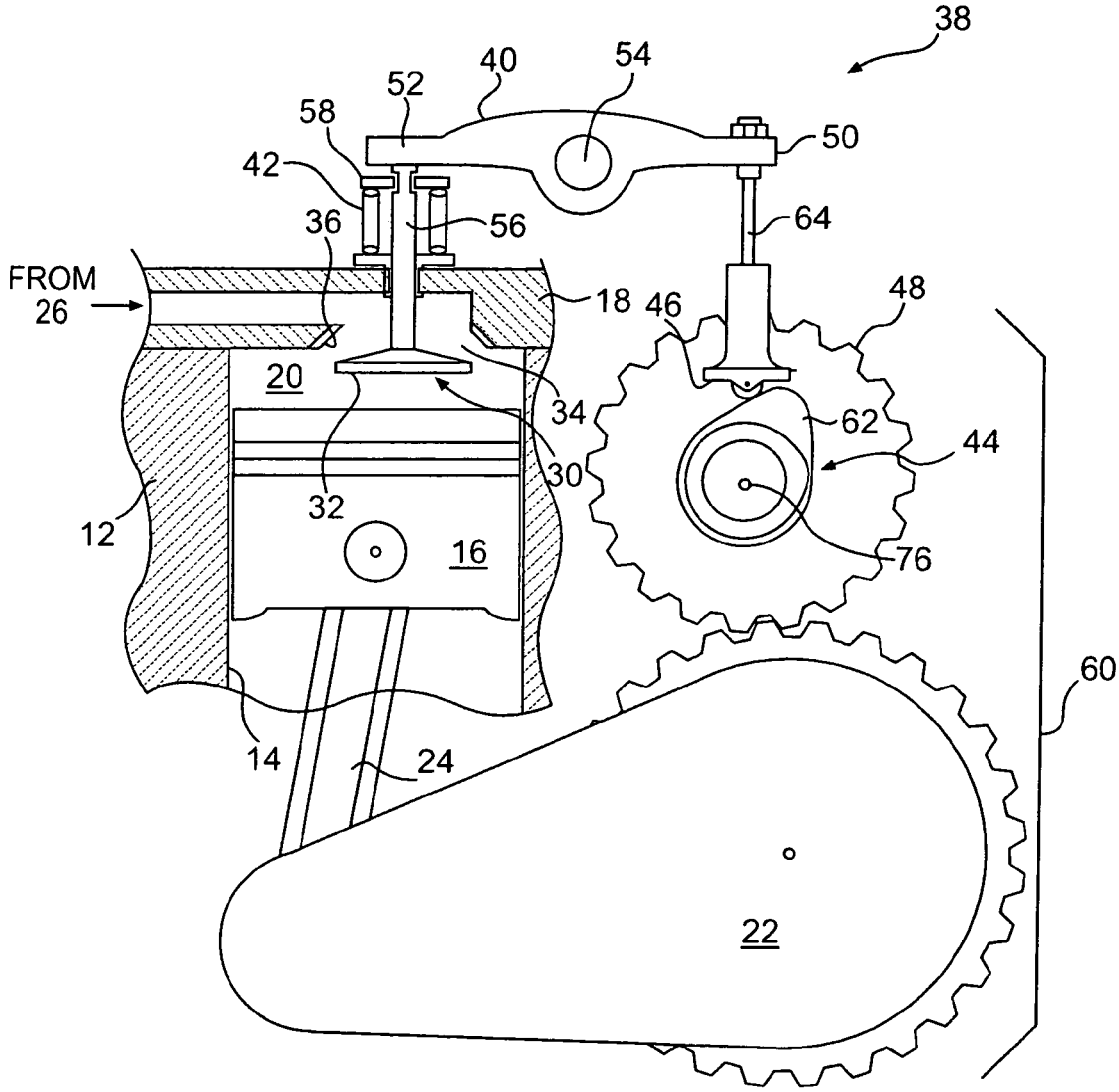
FIG. 2 is a side view diagrammatic and cross sectional illustration of an exemplary disclosed engine valve actuation system for use with the power system of FIG. 1.

As illustrated in FIG. 2, an intake valve 30 having a valve element 32 may be disposed within an intake opening 34 of cylinder head 18 to selectively engage a seat 36. Specifically, valve element 32 may be movable between a first position at which valve element 32 engages seat 36 to prevent a flow of fluid through intake opening 34, and a second position at which valve element 32 is removed from seat 36 to allow a flow of fluid through intake opening 34.

A series of valve actuation assemblies 38 (one of which is illustrated in FIG. 2) may be operatively engaged with power source 10 to move valve element 32 between the first and second positions. Another valve actuation assembly 38 may be provided to move an exhaust valve element (not shown) between the first and second positions, if desired. It should be noted that each cylinder head 18 could include multiple intake openings 34 and multiple exhaust openings (not shown). Each such opening would have an associated valve element. Power source 10 may include a valve actuation assembly 38 for each cylinder head 18 that is configured to actuate all of the intake valves 30 or all of the exhaust valves of that cylinder head 18. It is also contemplated that a single valve actuation assembly 38 could actuate the intake valves 30 associated with multiple cylinder heads 18, if desired. Each valve actuation assembly 38 may include a rocker arm 40, a valve spring 42, a common cam assembly 44, a cam follower 46, and a timing adjustment device 48.

Rocker arm 40 may move valve element 32 between the first and second positions. Specifically, rocker arm 40 may include a first end 50, a second end 52, and a pivot point 54. First end 50 of rocker arm 40 may operatively engage cam follower 46, while second end 52 may operatively engage valve element 32 through a valve stem 56. A rotation of rocker arm 40 about pivot point 54 may cause valve element 32 to move from the first position to the second position.

Valve spring 42 may act on valve stem 56 through a locking nut 58. In particular, valve spring 42 may bias valve element 32 into the first position, where valve element 32 engages seat 36 to prevent a flow of fluid through intake opening 34.

Cam assembly 44 may operatively engage crankshaft 22 of power source 10 in any manner readily apparent to one skilled in the art where a rotation of crankshaft 22 results in a corresponding rotation of cam assembly 44. For example, cam assembly 44 may connect to crankshaft 22 through a gear train 60 that increases the rotational speed of cam assembly 44 to approximately one half of the rotational speed of crankshaft 22. Alternatively, cam assembly 44 may connect to crankshaft 22 through a chain, a belt, or in any other appropriate manner. Cam assembly 44 may include at least one cam lobe 62, the shape of which may determine, at least in part, the actuation timing and lift of valve element 32 during an operation of power source 10.

Cam follower 46 may follow the profile of cam assembly 44 as it rotates and transfer a corresponding reciprocating motion to rocker arm 40. In particular, cam follower 46 may extend from cam assembly 44 to first end 50 of rocker arm 40. Cam follower 46 may engage and follow the profile of cam lobe 62 and, as cam assembly 44 rotates, the profile of cam lobe 62 may cause cam follower 46 to rise and lower. This rising and lowering motion may pivot rocker arm 40 about pivot point 54. Thus, the rotation of cam assembly 44 may cause valve element 32 to move from the first position to the second position to create a specific lift pattern associated with the profile of cam lobe 62. It is contemplated that a push rod 64 may be associated with cam follower 46, if desired, and disposed between cam follower 46 and rocker arm 40.

Figure 4:
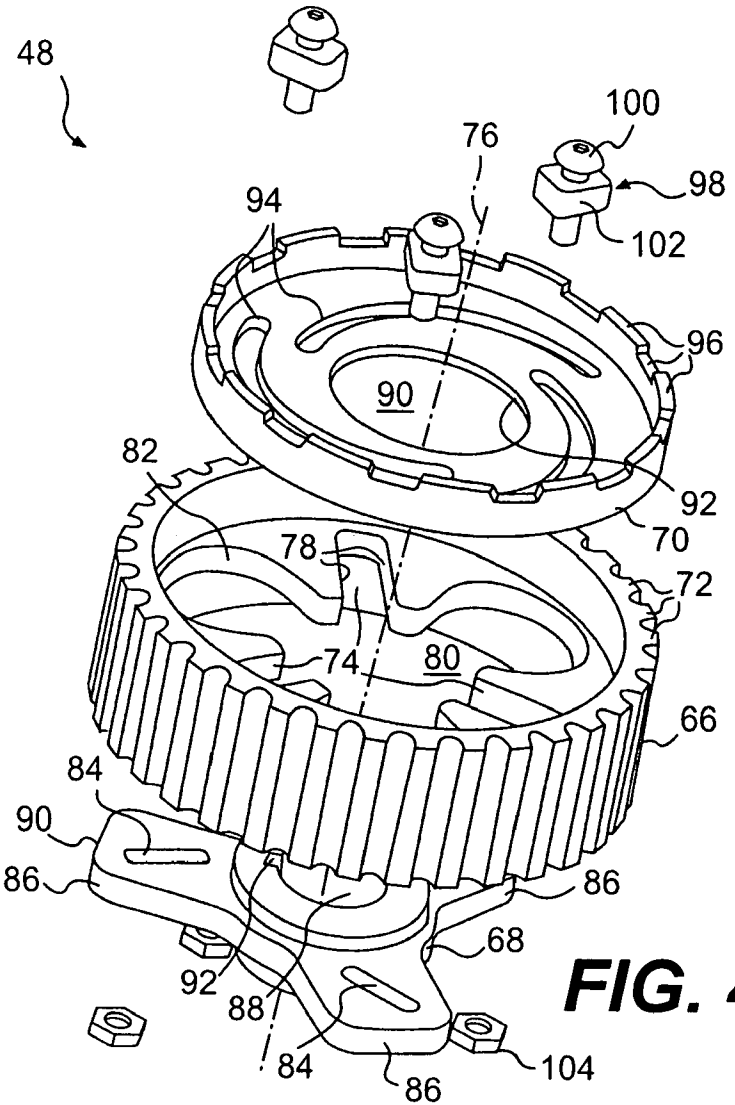
FIG. 4 is an exploded view of the timing adjustment device of FIG. 3.
Figure 3:
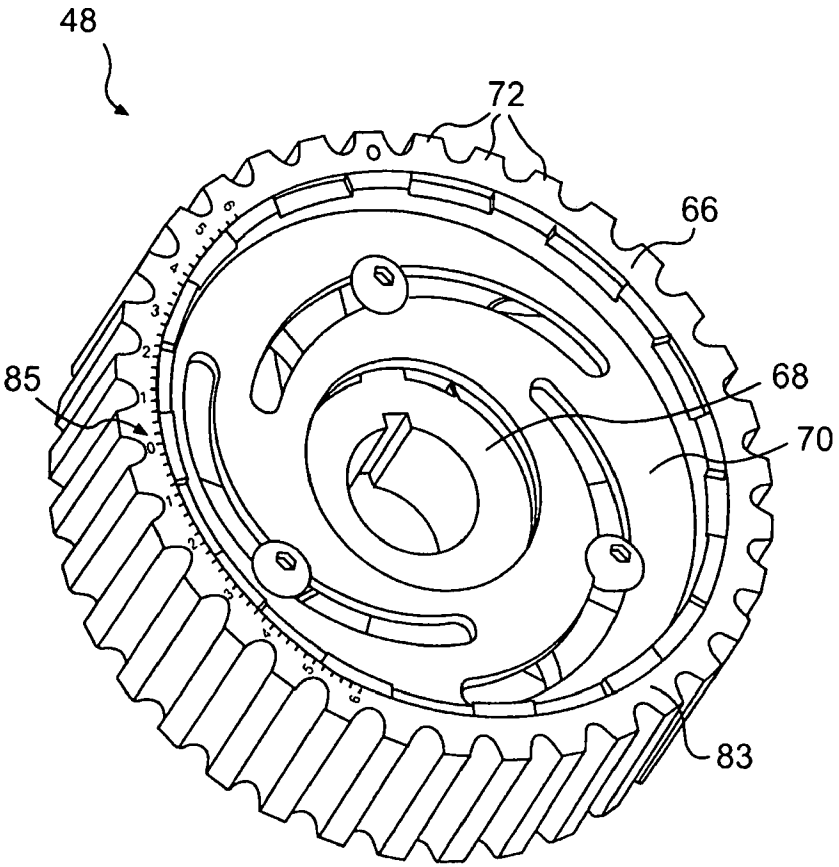
FIG. 3 is a pictorial illustration of an exemplary disclosed timing adjustment device for use with the engine valve actuation system of FIG. 2.

As illustrated in FIGS. 3 and 4, timing adjustment device 48 may include an assembly of components configured to adjust the relative timing between crankshaft 22 (referring to FIG. 2) and cam assembly 44. In one example, timing adjustment device 48 may include a driven device 66, a hub 68, and an adjuster 70.

Driven device 66 may operatively connect hub 68 to crankshaft 22 (referring to FIG. 2). Specifically, driven device 66 may include external protrusions 72 such as gear teeth, sprocket teeth, cog teeth, or any other suitable combination of protrusions and/or recesses for direct engagement with crankshaft 22 or indirect engagement by way of a chain or belt. The number and geometry of the protrusions may vary and be dependent on the application of power source 10. Driven device 66 may also include internal channels 74 directed from a point proximal protrusions 72 radially inward toward a central axis 76 associated with an opening 80 of driven device 66. In one example, internal channels 74 may have substantially parallel opposing surfaces 78 that are generally perpendicular to central axis 76. Although FIGS. 3 and 4 illustrate driven device 66 as having three internal channels 74, it is contemplated that a different number of internal channels 74 may be included within driven device 66, if desired. It is also contemplated that internal channels 75 may be rectangular, triangular, trapezoidal, or any other shape, when viewed from a face portion 83 of driven device 66. Face portion 83 of driven device 66 may include timing indicia 85 used for precise timing adjustment. It is further contemplated that driven device 66 may include recesses 82 for purposes of weight reduction.

Similar to driven device 66, hub 68 may also include internal channels 84 located within a plurality of support arms 86. However, in contrast to internal channels 74, internal channels 84 may be directed inward toward a point radially offset from central axis 76. That is, each of internal channels 84 may have a tangential component canted off the radius relative to central axis 76. It is contemplated that each of internal channels 84 may include a countersunk region, if desired, to receive a fastening device. It is further contemplated that the number of support arms 86 may correspond with the number of internal channels 84 or that separate support arms 86 may be omitted, if desired, and internal channels 84 alternatively located within a plate-like member. Similar to driven device 66, internal channels 84 of hub 68 may be rectangular, triangular, trapezoidal, or any other shape, when viewed from an end face of hub 68.

Hub 68 may also include a keyway 92 located within the wall forming central opening 88 for keyed connection to cam assembly 44 that restricts rotation of hub 68 relative to cam assembly 44. It is contemplated that multiple keyways may alternatively be included within hub 68, if desired. One or more set screws (not shown) may axially retain hub 68 in position relative to cam assembly 44.

Adjuster 70 may embody a substantially plate-like member having a central opening 90 and a plurality of overlapping annular channels 94 spiraling radially outward from central opening 90. When viewing an exposed surface of adjuster 70 after assembly to driven device 66, the radially outward spiraling direction of annular channels 94, although illustrated as being clockwise, may alternatively be counterclockwise. It is contemplated that adjuster 70 may include a means 96 for manually rotating adjuster 70 relative to driven device 66 by transmitting an applied toque to adjuster 70 in a substantially evenly distributed manner. Means 96 may include, among other things, a pattern of protrusions disposed around a periphery of adjuster 70, a pattern of recesses, a combination of protrusions and recesses, or any other similar means for manually rotating adjuster 70. Means 96 may be configured for axial or radial engagement with a mating service tool (not shown).

A plurality of locking devices 98 may axially secure driven device 66 and adjuster 70 to hub 68. Each of locking devices 98 may include a threaded fastener 100 such as a bolt, a slider block 102, and a threaded receiver 104 such as a nut for receiving threaded fastener 100. Threaded fastener 100 may be inserted through annular channel 94 of adjuster 70, through slider block 102 that is fitted within internal channel 74, through internal channel 84 of hub 68, and into engagement with threaded receiver 104. Slider block 102 may be sized to fit and slide within internal channel 74. That is, slider block 102 may have a thickness substantially the same as a thickness of internal channel 74, and a width just less than the width of internal channel 74. In this manner, when driven device 66, hub 68, and adjuster 70 are assembled (but not yet completely tightened), a rotation of adjuster 70 may result in radial movement of threaded fastener 100, slider block 102, and threaded receiver 104; substantially no movement of driven device 66; and a rotation of hub 68.

Figure 5:
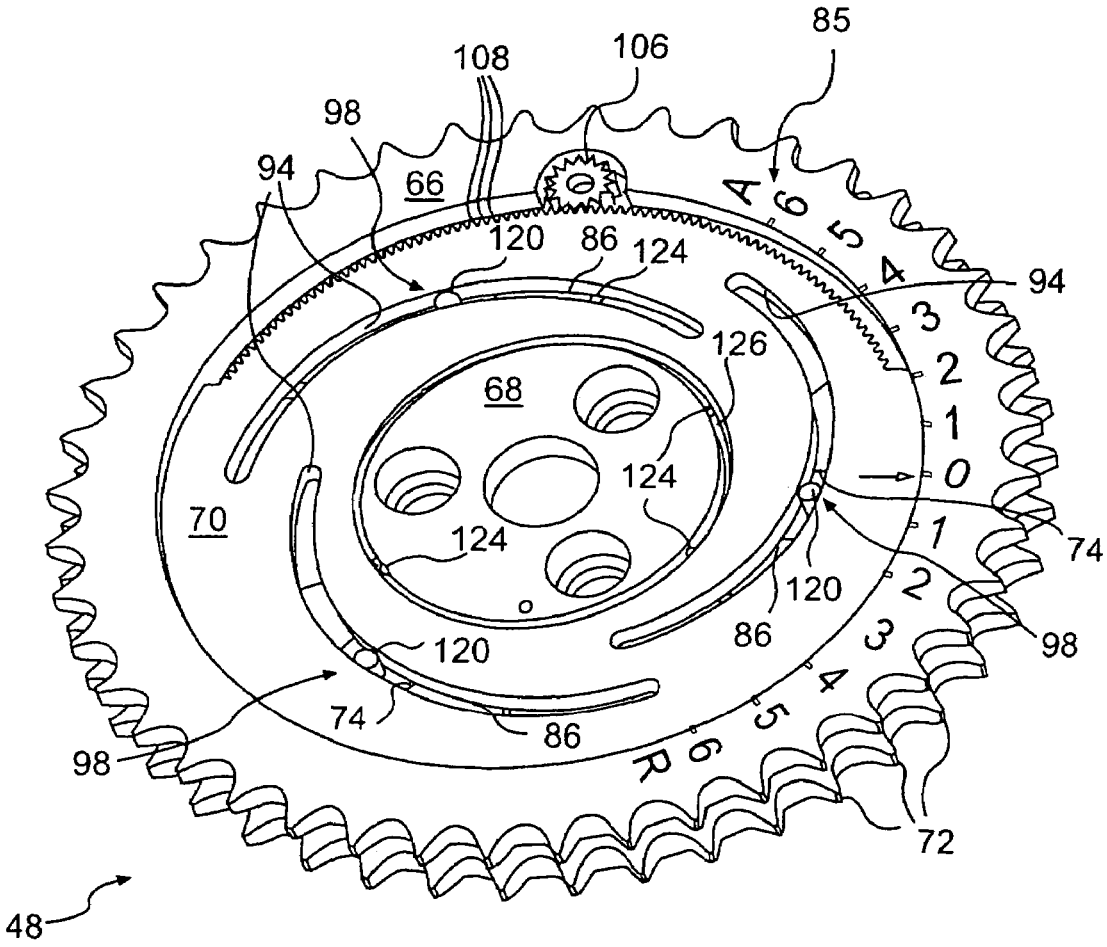
FIG. 5 is a pictorial illustration of another exemplary disclosed timing adjustment device for use with the engine valve actuation system of FIG. 2.

FIG. 5 illustrates an alternative embodiment of timing adjustment device 48. Similar to timing adjustment device 48 of FIGS. 3 and 4, timing adjustment device 48 of FIG. 5 includes driven device 66, hub 68, and adjuster 70. However, in contrast to timing adjustment device 48 of FIGS. 3 and 4, timing adjustment device 48 of FIG. 5 may include a precision tuner 106 configured to engage protrusions 108 located on a periphery of adjuster 70 for precise rotational adjustment of hub 68. In addition, locking devices 98 of FIG. 5 may provide only radial alignment of timing adjustment device 48.

Figure 6:
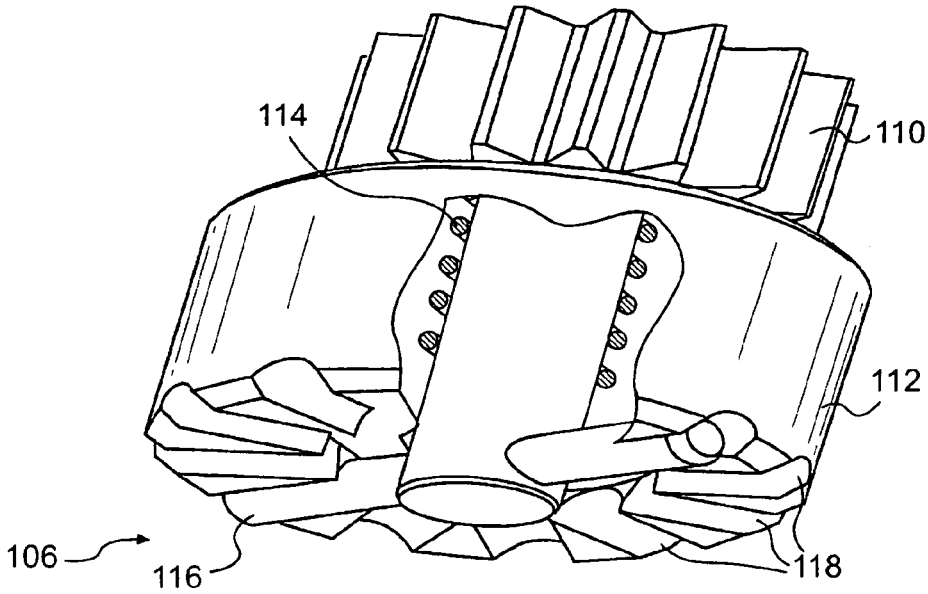
FIG. 6 is a pictorial illustration of an exemplary disclosed precision tuner for use with the timing adjustment device of FIG. 5.

As illustrated in FIG. 6, precision tuner 106 may include a pinion member 110 disposed within a housing 112 and biased by a spring 114 to engage a locking member 116 with a plurality of recesses 118. Pinion member 110 may be manually moved into housing 112 against the bias of spring 114 such that locking member 116 is retracted from recesses 118 to free pinion member 110 for rotation that rotationally orients adjuster 70. To lock pinion member 110 in a desired timing position and prevent further orienting of adjuster 70, spring 114 may be allowed to return pinion member 110 to a secure position at which locking member 116 extends into recesses 118. Because an effective diameter of pinion member 110 may be much smaller than an effective diameter of adjuster 70, a single revolution of pinion member 110 may result in only a small incremental angular rotation of adjuster 70. Although the relative effective diameters of pinion member 110 and adjuster 70 may be varied according to application, in one example, the ratio of pinion diameter to adjuster diameter may be about 1:10. It is contemplated that, rather than pinion member 110 being integral to timing adjustment device 48, pinion member 110 may alternatively be integral with a removable service tool (not shown). In addition, although illustrated as being rotatable, having spur gear teeth, and being longitudinally aligned with adjuster 70, it is contemplated that pinion member 110 may alternatively embody a translating rack mechanism, have beveled gear teeth, and/or be disposed substantially tangent to adjuster 70.

Figure 7:
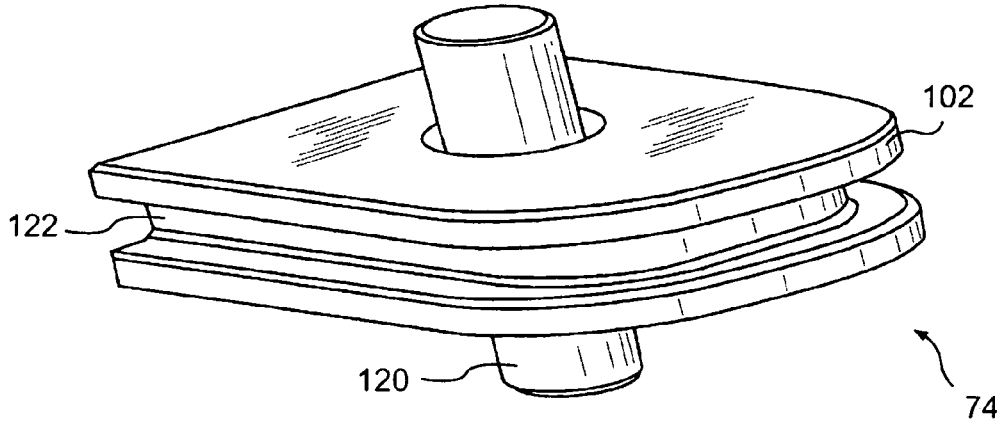
FIG. 7 is a pictorial illustration of an exemplary disclosed locking device for use with the timing adjustment device of FIG. 5.

In contrast to locking devices 98 of FIGS. 3 and 4, locking devices 98 of FIGS. 5 and 7 may impart little or no axial retaining force to timing adjustment device 48. In particular, each of locking devices 98 of FIGS. 5 and 7 may include a stud 120 that threadingly engages slider block 102 and is slidingly received by internal channels 84 and 94. It is contemplated that stud 120 may alternatively be integral to slider block 102, if desired. Slider block 102 may include a continuous groove 122 formed around three sides of slider block 102. Groove 122 may receive opposing surfaces 78 of internal channel 74 to minimize axial movement of slider block 102. Instead of locking devices 98 providing an axial retaining force, another means for providing axial retaining force may alternatively be implemented. This means for providing axial retaining force may include, among other things, a plurality of external radially oriented protrusions 124 associated with hub 68 that may engage a land 126 of adjuster 70. It is contemplated that protrusions 124 may be spring loaded to move into and out of engagement with land 126 or that the means for providing axial retaining force may alternatively or additionally include a C-clip configured to engage a groove (not shown) in hub 68, if desired. In this embodiment, hub 68 may be bolted to cam assembly 44.

INDUSTRIAL APPLICABILITY

The disclosed adjustable valve timing system may be applicable to any power source where adjustment of intake and/or exhaust valves may improve performance of the power source. In particular, the disclosed system may improve fuel efficiency, exhaust emissions, power output, responsiveness, engine braking, and/or other similar power source parameters by facilitating accurate, reliable, and quick valve timing adjustments. The operation of timing adjustment device 48 will now be explained.

To change the relative timing of cam assembly 44 once timing adjustment device 48 of FIGS. 3 and 4 has been assembled to power source 10, threaded fasteners 100 may first be loosened. Threaded fasteners 100 may be loosened by applying torque in a counterclockwise manner to an engagement area of threaded fasteners 100 by way of a male or female-type service tool such as an Allen wrench or a hexagonal socket. Threaded fasteners 100 need not be completely removed from timing adjustment device 48 to adjust the timing of cam assembly 44, but may be completely removed, if desired.

Once threaded fasteners 100 are loosened, adjuster 70 may be manually rotated to cause radial movement of threaded fasteners 100. In particular, because of the spiral nature of annular channels 94, as adjuster 70 is rotated, sidewalls of annular channels 94 may press against a stem portion of threaded fasteners 100 and either urge threaded fasteners 100 radially inward or outward to either advance or retard the timing of cam assembly 44. For example, as adjuster 70 is rotated in a clockwise direction when viewed from the visible end of assembled timing adjustment device 48, an outer sidewall of annular channels 94 may press against and urge threaded fasteners 100 inward to advance the timing of cam assembly 44. Conversely, as adjuster 70 is rotated in a counterclockwise direction, an inner sidewall of annular channels 94 may urge threaded fasteners 100 outward to retard the timing of cam assembly 44.

As threaded fasteners 100 are moved radially inward or outward, hub 68 may be urged to rotate relative to driven device 66. In particular, because of the tangential disposition of internal channels 84 relative to central axis 76, as threaded fasteners 100 are moved radially inward, the stem of threaded fasteners 100 may press against sidewall portions of internal channels 84 resulting in a counterclockwise rotation of hub 68. Conversely, as threaded fasteners 100 are moved radially outward, threaded fasteners 100 pressing against the sidewall portions of internal channels 84 may result in the clockwise rotation of hub 68. It is contemplated that internal channels 84 may be oriented in another tangentially sloping direction, if preferred, such that a radially inward movement of threaded fasteners 100 results in a counterclockwise rotation of hub 68, and a radially outward movement of threaded fasteners 100 results in a clockwise rotation of hub 68.

Because internal channels 74 of driven device 66 may be directed radially inward toward central axis 76, the radial movement of threaded fasteners 100 may result in the radial movement of slider blocks 102 without significant rotational movement of driven device 66. That is, because slider blocks 102 may be free to slide within internal channels 74 and because internal channels 74 may be substantially aligned with the radial motion of threaded fasteners 100, minimal tangential force may be applied to driven device 66 during adjustment of timing adjustment device 48. In addition, because driven device 66 may be coupled to crankshaft 22, tangential force that might be applied to driven device 66 during the adjustment process may be transmitted to crankshaft 22, thereby reducing the tendency of driven device 66 to rotate.

Because the forces applied by crankshaft 22 to driven device 66 during operation of power source 10 may be nearly completely tangential in direction (e.g., crankshaft 22 may only apply a torque to driven device 66), the rotational forces from crankshaft 22 may be transmitted from opposing surfaces 78 of internal channels 74 directly through slider blocks 102 and threaded fasteners 100 to hub 68, with minimal risk of threaded fasteners 100 radially slipping and driven device 66 subsequently rotationally slipping relative to hub 68. That is, even if threaded fasteners 100 were to become loosened during operation of power source 10, the likelihood of driven device 66 rotationally slipping relative to hub 68 may be low because timing adjustment device 48 may not rely on a clamping force to transmit the applied torque. In fact, because the axial retaining force associated with the embodiment of FIG. 5 is provided solely by way of protrusions 124 or an alternative C-clip, the step of loosening may be completely omitted from the adjustment process, if desired. By omitting the step of loosening and subsequently retightening, the time consumed by the adjustment process may be greatly reduced.

Manual torque may be applied to adjuster 70 until a desired timing angle has been achieved. With reference to the embodiment of FIGS. 3 and 4, the torque may be applied substantially evenly around a periphery of adjuster 70 via a service tool configured to engage means 96. With reference to the embodiment of FIG. 5, the torque may be applied via precision tuner 106. To utilize precision tuner 106, pinion member 110 may be depressed to retract locking device 116 from recesses 118, rotated to achieve the correct alignment, and then released to re-engage locking device 116 with recesses 118. Adjuster 70 may be rotated until a timing indicia 85 on adjuster 70 aligns with a desired corresponding timing indicia 85 on face portion 83 of driven device 66. If locking devices 98 were loosened during the adjustment process (referring to the embodiment of FIGS. 3 and 4 only), locking devices 98 may be retightened following the desired alignment of timing indicia 85.

As hub 68 is rotated relative to engagement device 66, the opening and closing motion of intake valve 30 may be advanced or retarded. In particular, if the operational rotation of hub 66 is normally clockwise and, during the adjustment process described above, is rotated in a clockwise direction relative to engagement device 66, the timing of intake valve 30 may be advanced. That is cam lobe 62 may be rotated into contact with intake valve 30 to open intake valve 30 sooner than before the adjustment was made. If the operational rotation of hub 66 is clockwise and, during the adjustment process described above, is rotated in a counterclockwise direction relative to engagement device 66, the timing of intake valve 30 may be retarded. That is cam lobe 62 may be rotated into contact with intake valve 30 to open intake valve 30 later than before the adjustment was made. In either situation, although the angular orientation of cam lobe 62 and resulting valve actuation period may be advanced or retarded, the lift and profile of valve motion may remain substantially unchanged.

It will be apparent to those skilled in the art that various modifications and variations can be made to the disclosed adjustable valve timing system. Other embodiments will be apparent to those skilled in the art from consideration of the specification and practice of the disclosed adjustable valve timing system. For example, instead of tangentially oriented internal channels 84 being located within hub 68, it is contemplated that internal channels 84 within hub 68 could be directly radially aligned with central axis 76 and internal channels 74 within driven device 66 alternatively tangentially disposed. In addition, although the process of timing adjustment is described as being manually completed, it is contemplated that a powered service tool may alternatively be utilized to apply torque directly or indirectly to adjuster 70, if desired. It is intended that the specification and examples be considered as exemplary only, with a true scope being indicated by the following claims and their equivalents.

What is claimed is:

1. An adjustment device for changing the rotational timing between a cam and a crankshaft, the adjustment device comprising:

a driven device operatively connected to the crankshaft and having a first plurality of channels directed radially inward toward a central axis; and a hub axially aligned with the driven device along the central axis and connectable to the cam, the hub having a second plurality of channels, wherein each channel originates at a respective first point and is directed inward toward a respective second point radially offset from the first point and the central axis.

2. The adjustment device of claim 1, further including an adjuster having a third plurality of channels spiraled away from the central axis.

3. The adjustment device of claim 2, further including a slider block disposed within each of the first plurality of channels.

4. The adjustment device of claim 3, further including a fastener extending through opposing sides of the slider block to engage the adjuster and the hub, wherein a rotation of the adjustment device relative to the driven device results in radial movement of the slider block and a rotation of the hub relative to the driven device.

5. The adjustment device of claim 3, wherein the slider block includes a continuous groove configured to engage sidewall portions of the first plurality of channels.

6. The adjustment device of claim 2, further including a tuner mechanism operatively coupled to the adjuster.

7. The adjustment device of claim 6, wherein the tuner includes a spring biased pinion member having an effective diameter less than an effective diameter of the adjuster.

8. The adjustment device of claim 7, further including a locking device configured to selectively prevent rotation of the pinion member.

9. The adjustment device of claim 2, wherein the adjuster further includes a means for manually rotating the adjuster.

10. The adjustment device of claim 9, wherein the means for manually rotating includes a plurality of protrusions extending in an axial direction on the adjuster.

11. The adjustment device of claim 2, further including a means for providing axial retaining force.

12. The adjustment device of claim 1, further including indicia located on a face of the driven member.

13. An adjustment device for changing the rotational timing between a cam and a crankshaft, the adjustment device comprising:

a driven device operatively connected to the crankshaft and having a first plurality of channels directed radially inward toward a central axis;

a hub axially aligned with the driven device along the central axis and connectable to the cam; and an adjuster, wherein one of the hub and the adjuster includes a second plurality of channels, wherein each of the second plurality of channels originates at a respective first point and is directed inward toward a respective second point radially offset from the first point and the central axis, and the other of the hub and the adjuster includes a third plurality of channels spiraled away from the central axis.

14. A method of adjusting valve timing, comprising applying torque to an adjuster, wherein the application of torque results in:

a radial movement of a slider block;

a movement of a slider block fastener with respect to a hub, wherein the movement of the slider block fastener is along a line offset from a central axis of the hub; and a rotation of the hub;

wherein applying torque includes applying torque to the adjuster until a timing indicia on the adjuster aligns with a desired timing indicia on a driven member that houses the slider block; and wherein the fastener extends through the slider block and the method further includes:

loosening the fastener prior to applying torque; and tightening the fastener after the timing indicia on the adjuster aligns with the desired timing indicia on the driven member.

15. A power system, comprising:

a power source having a crankshaft and a cam;

a driven device operatively connected to the crankshaft and having a first plurality of channels directed radially inward toward a central axis;

a hub axially aligned with the driven device along the central axis and connectable to the cam, the hub having a second plurality of channels, wherein each of the second plurality of channels originates at a respective first point and is directed inward toward a respective second point radially offset from the first point and the central axis;

an adjuster having a third plurality of channels spiraled away from the central axis;

a slider block disposed within each of the first plurality of channels; and a fastener extending through opposing sides of the slider block to engage the adjuster and the hub, wherein a rotation of the adjuster relative to the driven device results in radial movement of the slider block and a rotation of the hub relative to the driven device.

16. The power system of claim 15, further including a tuner mechanism operatively coupled to the adjuster, wherein the tuner includes:

a spring biased pinion member having an effective diameter less than an effective diameter of the adjuster; and a locking device configured to selectively prevent rotation of the pinion member.

* * * * *